US007127753B1

(12) United States Patent
Ramaley

(10) Patent No.: US 7,127,753 B1
(45) Date of Patent: Oct. 31, 2006

(54) SLEEPING BAG SYSTEM

(75) Inventor: Linda A. Ramaley, 361 E. Comstock Ave., Pahrump, NV (US) 89048

(73) Assignee: Linda A. Ramaley, Pahrump, NV (US)

( * ) Notice: Subject to any disclaimer, the term of this patent is extended or adjusted under 35 U.S.C. 154(b) by 257 days.

(21) Appl. No.: 10/730,830

(22) Filed: Dec. 8, 2003

(51) Int. Cl.
*A41B 13/06* (2006.01)

(52) U.S. Cl. ..... 5/413 R; 5/414; 135/137; 135/96

(58) Field of Classification Search ..... 5/413 R, 5/413 AM, 414, 485; 135/96, 117, 118, 137; 2/114, 86, 102, 94, 89, 247–257; 190/109, 190/111, 112, 903; 150/112, 117, 151; 24/427, 24/422, 382–384
See application file for complete search history.

(56) References Cited

U.S. PATENT DOCUMENTS

| | | | | | |
|---|---|---|---|---|---|
| 788,791 | A * | 5/1905 | Peralta | 135/156 |
| 867,464 | A * | 10/1907 | Abbott | 5/413 R |
| 1,247,882 | A * | 11/1917 | Row | 5/413 R |
| 1,484,361 | A * | 2/1924 | Soyland | 5/413 R |
| 1,670,460 | A * | 5/1928 | Leibold | 5/413 R |
| 2,259,267 | A * | 10/1941 | Ranken | 5/413 R |
| 3,751,741 | A * | 8/1973 | Hendry | 5/413 AM |
| 3,840,919 | A | 10/1974 | Middleton | 5/343 |
| 3,860,980 | A | 1/1975 | Ebert | 5/343 |
| 4,605,029 | A | 8/1986 | Russel | 135/104 |
| 4,719,935 | A | 1/1988 | Gustafson | 135/102 |
| 4,757,832 | A | 7/1988 | Russel | 135/106 |
| 4,766,918 | A * | 8/1988 | Odekirk | 52/2.23 |
| 4,939,803 | A * | 7/1990 | Waters | 5/414 |
| 5,458,146 | A | 10/1995 | Gregg | 135/91 |
| 6,192,909 | B1 * | 2/2001 | Strausser | 135/137 |
| 6,672,323 | B1 * | 1/2004 | Gupta et al. | 135/126 |

* cited by examiner

*Primary Examiner*—Jong-Suk (James) Lee
*Assistant Examiner*—Gilbert Lee
(74) *Attorney, Agent, or Firm*—Michael S. Neustel

(57) ABSTRACT

A sleeping bag system for providing all items necessary to provide shelter, comfort and protection from the elements for outdoor sleeping. The sleeping bag system includes a sleeping bag with its own attached canopy which includes a top cover, two side panels with mesh windows, window rain flap protection and an end panel with two-way storage pocket. The sleeping bag has a slot underneath it for receiving an air-mattress or pad. The canopy is held into position during use with two support poles. These support poles are held into place with support pole sleeves attached to the top of the canopy. The canopy includes attached tie down straps. Compartments within the canopy are used for storing poles, stakes and other items when the canopy is not in use. The entire system can be folded and rolled up for easy storage and transport.

20 Claims, 8 Drawing Sheets

SLEEPING BAG SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to outdoor sleeping equipment and more specifically it relates to a sleeping bag system for providing those items necessary to provide optimum space, comfort and protection from the elements for outdoor sleeping.

2. Description of the Prior Art

Outdoor portable sleeping equipment has been in use for years. Typically, outdoor portable sleeping equipment requires an individual to carry separately a tent, sleeping bag, and air-mattress or pad. Existing shelter systems do not traditionally combine all necessary elements into one system. Additionally, those systems which attempt to combine some or all of the elements of a tent, sleeping bag and air mattress or pad provide limited space for the occupant once the structure is erected. Current systems mostly provide a ground cover connected to an inflatable or self-supporting shelter.

In an effort to minimize size and weight the prior art combination systems consistently provide limited internal space for the occupant. Current designs are limited in their ability to provide the benefits of side mesh windows allowing cross-flow air ventilation and insect protection. Additionally, prior art current systems have semi-circular support structures which minimize comfort and storage space for the occupant.

Examples of patented devices which are related to the present invention include U.S. Pat. No. 4,757,832 to Russel; U.S. Pat. No. 4,605,029 to Russel; U.S. Pat. No. 5,458,146 to Gregg; U.S. Pat. No. 4,719,935 to Gustafson; U.S. Pat. No. 3,860,980 to Ebert; and U.S. Pat. No. 3,840,919 to Middleton.

Russel (U.S. Pat. No. 4,757,832) discloses a self-supporting outdoor sleeping system. Russel teaches a ground cover sheet to which a tent cover is attached to the form of a body section and a head section.

Russel (U.S. Pat. No. 4,605,029) discloses a self-supporting outdoor sleeping system similar in structure to the previous patent using flexible rods to provide a semi-circular enclosure.

Gregg (U.S. Pat. No. 5,458,146) discloses a portable shelter system. Gregg teaches a one-person shelter with an internal support structure to hold the structure open.

While these devices may be suitable for the particular purpose to which they address, they are not as suitable for providing those items necessary to provide optimum space, comfort and protection from the elements for outdoor sleeping. All current combination systems are erected in a semi-circular position attempting to minimize weight and size of the system. By using a semicircular design these systems fail to benefit from the advantages available in the current design. The prior art systems do not provide the space necessary to sit within the structure. Current combination systems are limited to providing the occupant a place to sleep and be protected from the elements.

In these respects, the sleeping bag system according to the present invention substantially departs from the conventional concepts and designs of the prior art, and in so doing provides an apparatus primarily developed for the purpose of providing all items necessary to provide shelter, comfort, security and protection from the elements for outdoor sleeping.

SUMMARY OF THE INVENTION

In view of the foregoing disadvantages inherent in the known types of outdoor sleeping equipment now present in the prior art, the present invention provides a new sleeping bag system construction wherein the same can be utilized for providing those items necessary to provide shelter, comfort and protection from the elements for outdoor camping.

The general purpose of the present invention, which will be described subsequently in greater detail, is to provide a new sleeping bag system that has many of the advantages of the combination outdoor sleeping equipment mentioned heretofore and many novel features that result in a new sleeping bag system which is not anticipated, rendered obvious, suggested, or even implied by any of the prior art outdoor sleeping equipment, either alone or in any combination thereof.

To attain this, the present invention generally comprises a sleeping bag with its own attached canopy which includes a top cover, two side panels with mesh windows, window rain flap protection and an end panel with two-way storage pocket. The sleeping bag has a slot underneath it for receiving an air-mattress or pad. The canopy is held into position during use with two support poles. These support poles are held into place with support pole sleeves attached to the top of the canopy. The canopy includes attached tie down straps. Compartments within the canopy are used for storing poles, stakes and other items when the canopy is not in use. The entire system can be folded and rolled up for easy storage and transport.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a sleeping bag system that will overcome the shortcomings of the prior art devices.

A second object is to provide a sleeping bag system for providing those items necessary to provide shelter, comfort and protection from the elements for outdoor sleeping.

Another object is to provide a sleeping bag system that allows using either an air-mattress or a pad.

An additional object is to provide a sleeping bag system that is compact when not in use.

A further object is to provide a sleeping bag system that includes storage compartments for all items necessary to erect and set-up the system.

Another object is to provide a sleeping bag system that is convenient to use and easy to erect.

Another object is to provide a sleeping bag system that allows the canopy to be placed into a number of different configurations.

A further object is to provide a sleeping bag system that allows proper ventilation of the system when the canopy section is erected and closed.

An additional object is to provide a sleeping bag system that allows the use of an extra or attached ground cloth.

Another object is to provide a sleeping bag system that includes tie downs for added stability during inclement weather.

Another object is to provide a sleeping bag system that includes sufficient interior space to allow the occupant to sit-up within the system.

A further object is to provide a sleeping bag system that allows the sleeping bag element to be detachable.

Another object is to provide a sleeping bag system that includes a two-way storage pocket so that the closed canopy does not need to be opened to get items previously stored.

Another object is to provide a sleeping bag system that includes a water and fire resistant floor covering and canopy.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
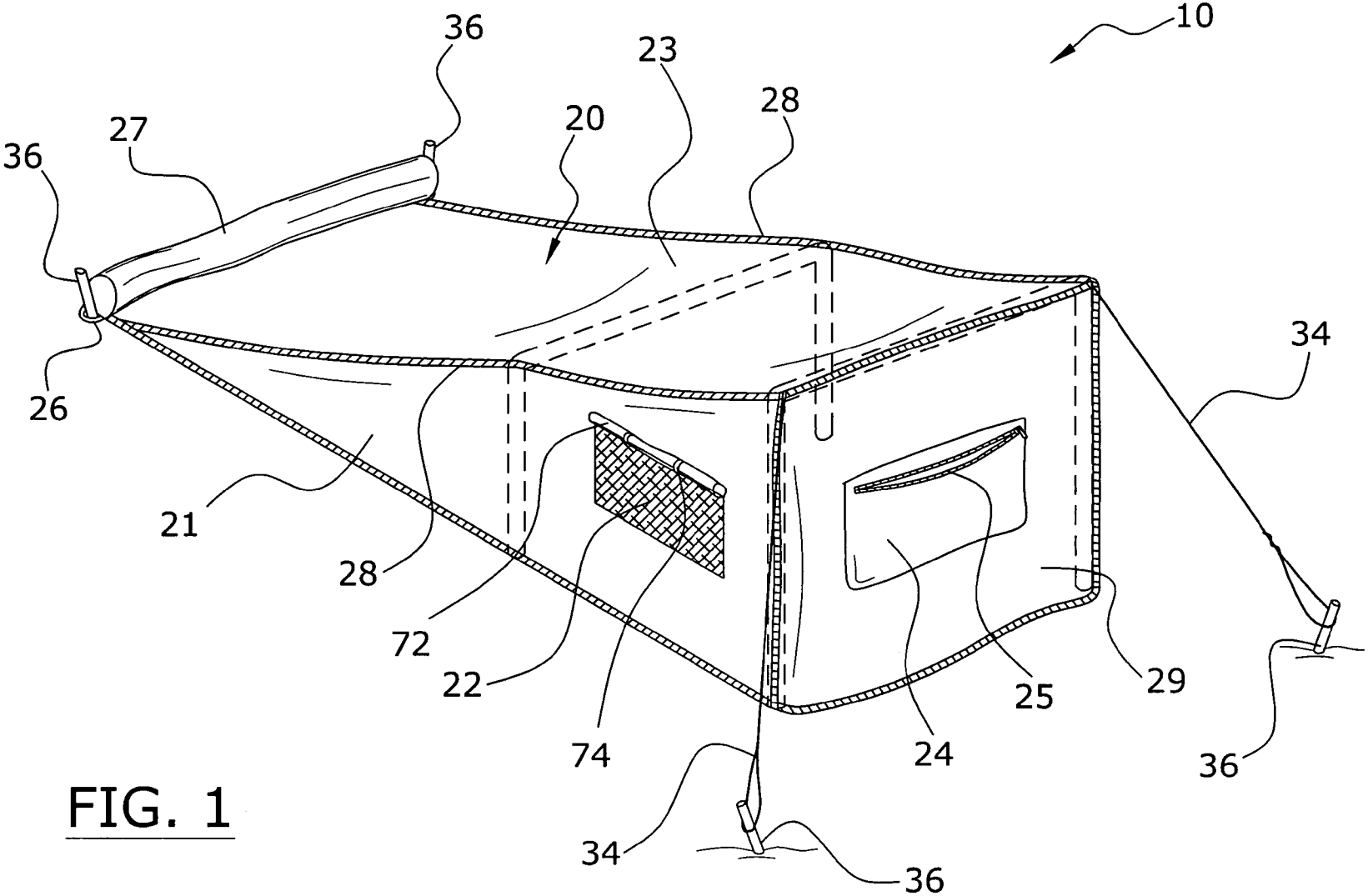
FIG. 1 is an elevated oblique side view of the present invention.
Figure 2:
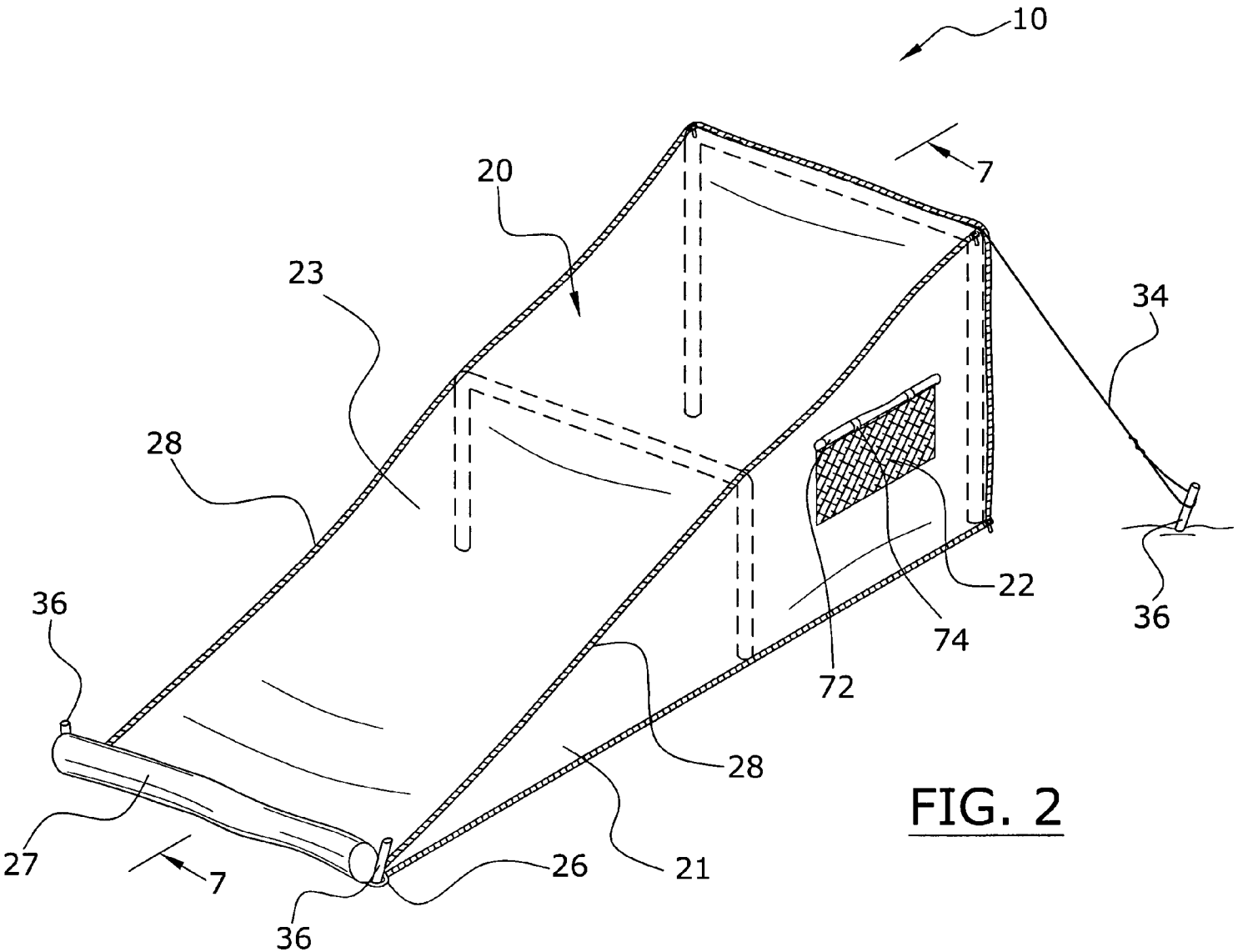
FIG. 2 is an elevated rear oblique side view of the present invention.

Turning now descriptively to the drawings, in which similar reference characters denote similar elements throughout the several views, FIGS. 1 through 8*c* illustrate a sleeping bag system 10, which comprises a sleeping bag 60, a canopy with walls 20, a ground cloth 40, support poles 30 and 32, and tie-down ropes 34 with stakes 36. The sleeping bag 60 is fastened to the ground cloth 40. The sleeping bag 60 has an insertion slot 52 between the sleeping bag 60 and the ground cloth 40 which permits the insertion of an air mattress or pad 50. Attached along the four sides of the ground cloth 40 is the canopy comprising two side panels 21, a top panel 23 and an end panel 29. Both the top panel 23 and the end panel 29 contain storage compartments 24 and 27. The canopy 20 when erected is given its structure by two internal support poles 30 and 32.

Figure 3:
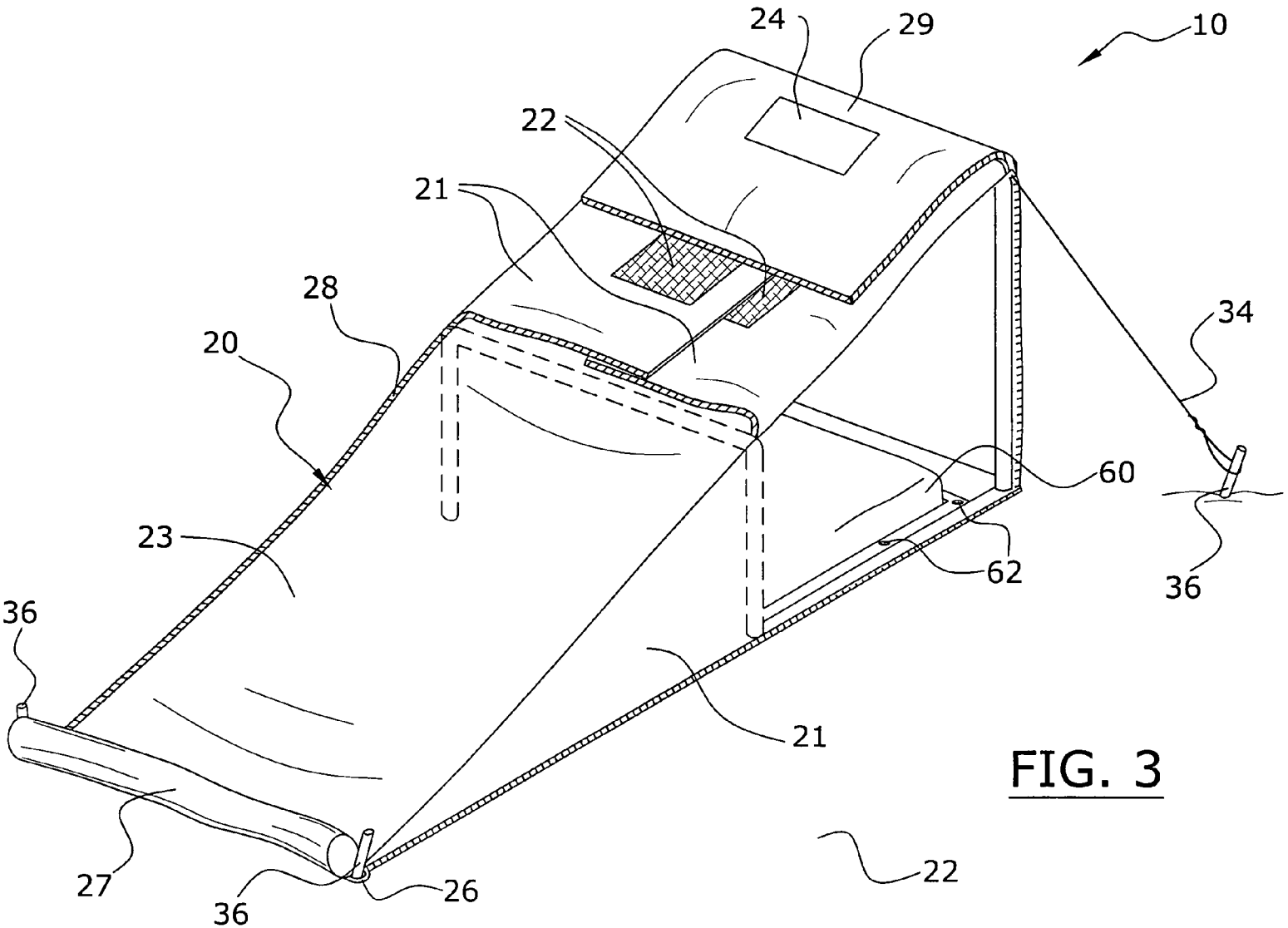
FIG. 3 is a elevated oblique side view as in FIG. 2 with the side panels opened.
Figure 4:
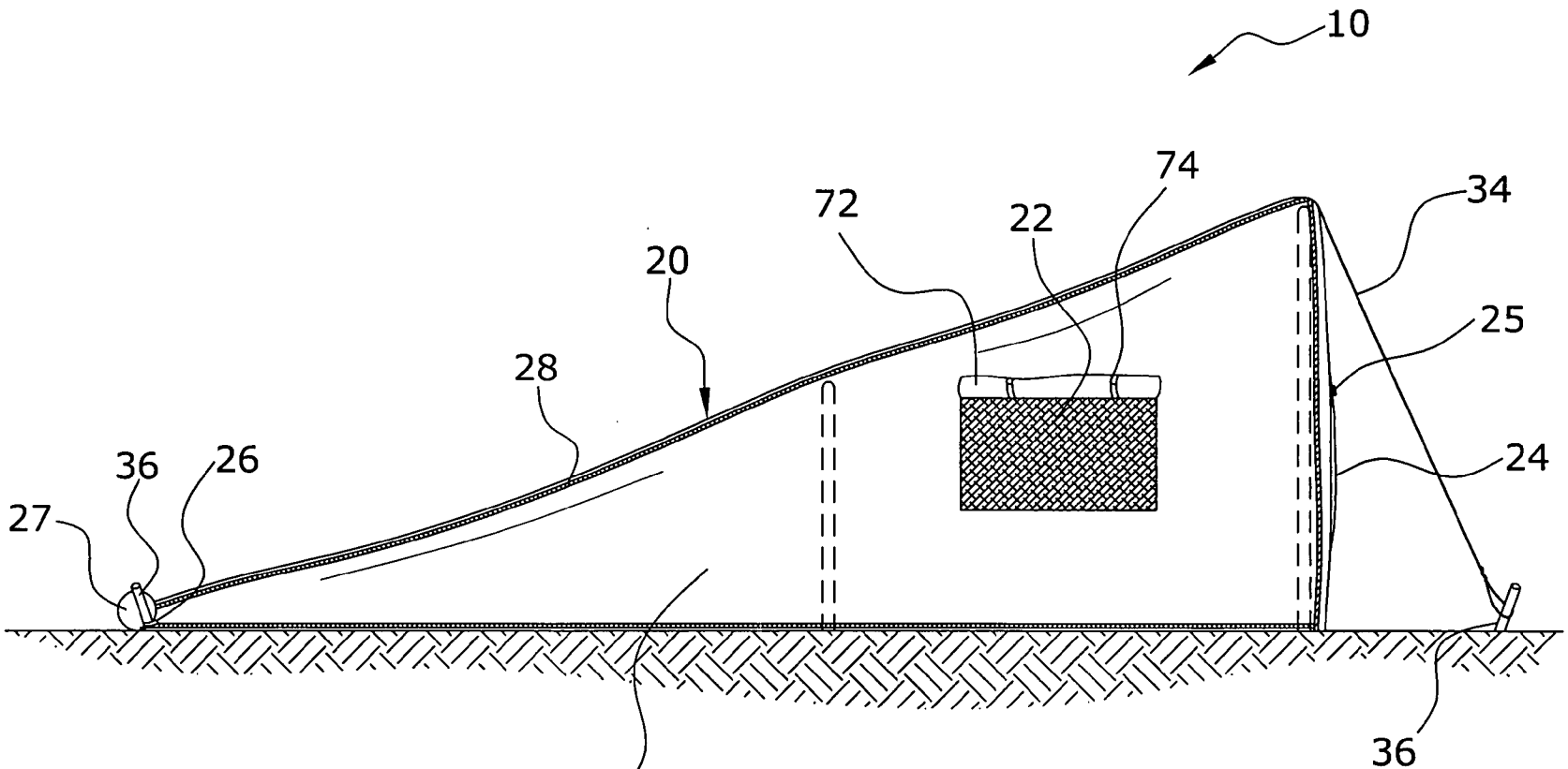
FIG. 4 is a side view of the present invention
Figure 5:
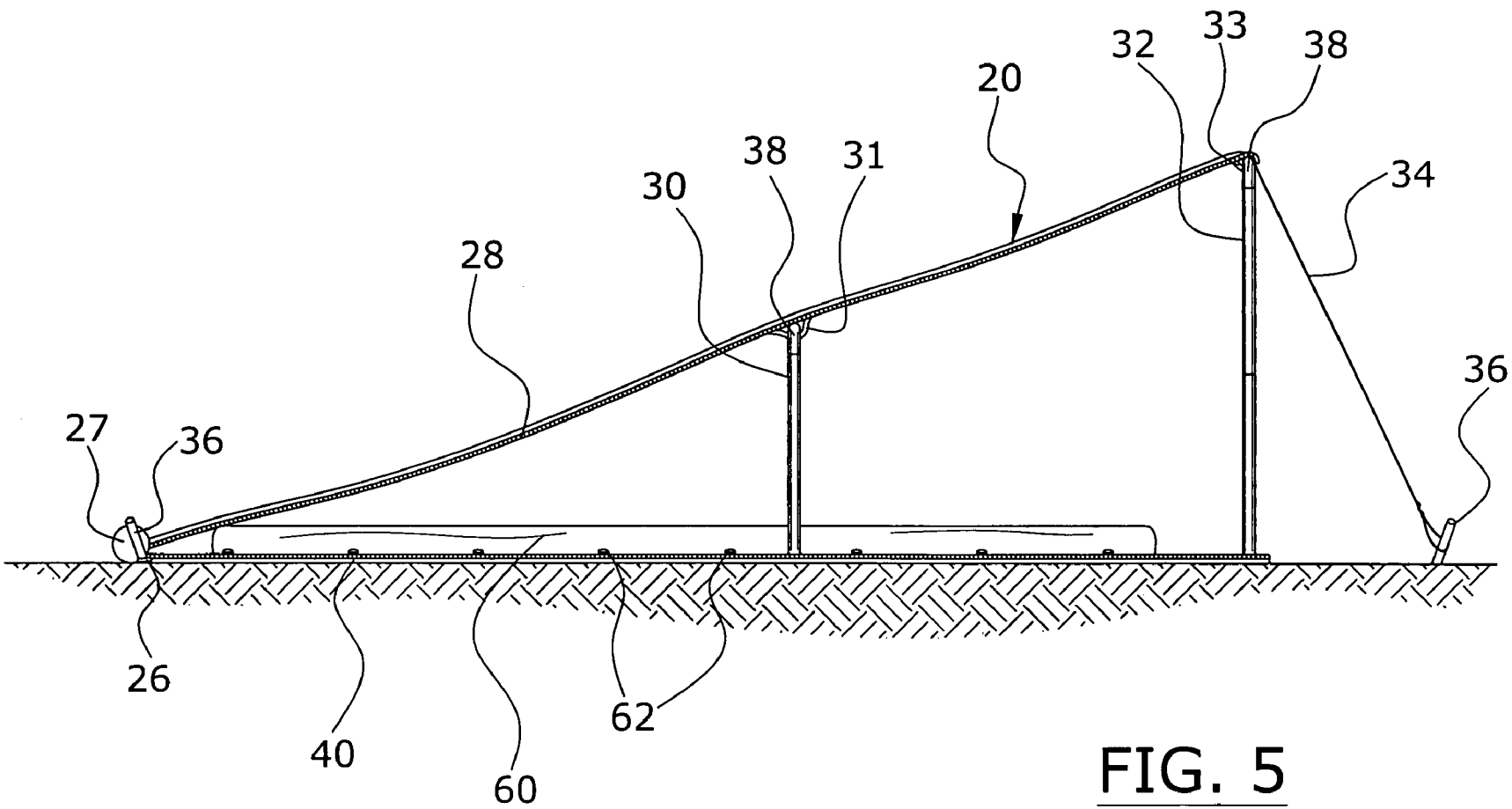
FIG. 5 is a side view of the present invention with the side panel removed.
Figure 6:
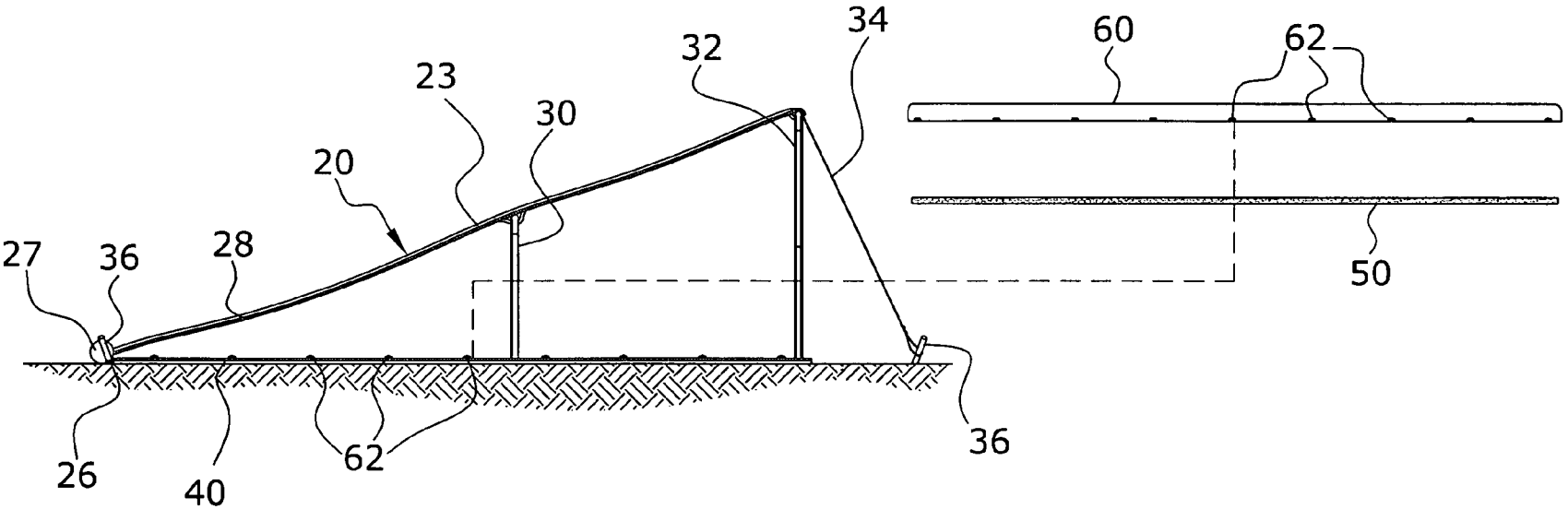
FIG. 6 is a side view illustrating the stake tie down locations.

The external shell 64 of the sleeping bag 60 is preferably constructed using standard sleeping bag construction fabric. The sleeping bag shell 64 may be filled with standard sleeping bag insulating material. As best seen in FIGS. 3 and 5, the sleeping bag 60 is attached on two sides to the ground cloth 40 with fasteners 62. The head-end side of the sleeping bag 60 is not attached to the ground cloth 40. The fasteners 62 may be constructed from hook and loop fasteners, snaps, or any other suitable fastening material. The sleeping bag 60 is preferably constructed to be shorter in length than the ground cloth 40. Located between the head-end side of the sleeping bag 60 and the ground cloth 40 is an insertion slot 52 for an air mattress or pad 50. When an air-mattress or pad 50 is inserted into the insertion slot 52 it is sandwiched between the sleeping bag 60 and the ground cloth 40 section of the sleeping bag system.

The ground cloth 40 is preferably made from a waterproof or water resistant material. Attached to the foot-end of the ground cloth 40 are two end rings 26 which are best seen in FIG. 1. The ground cloth 40 can be secured to the ground using stakes 36 inserted into the two end rings 26. Attached to the ground cloth 40 on all four sides is the canopy structure 20. The ground cloth 40 may be attached to the canopy structure using zippers or some other suitable fastener. The canopy structure 20 consists of two side panels 21, one top panel 23 and one end panel 29. The canopy structure 20 is preferably made from water resistant material. The canopy structure 20 may be constructed with camouflage patterned material. However, it can be appreciated by one skilled in the art that other embodiments of the present invention may include canopy structures 20 made from material with other physical properties and appearance.

The side panels 21 are attached to the ground cover 40, the end panel 29, and the top panel 23 by zippers 28 or some other suitable fasteners. Located on each side panel 21 is a window 22. The window 22 is preferably made from mesh material or some other suitable material which will keep insects out of the sleeping bag system, but allow air to flow through the window. Each window 22 preferably has a rain flap 72 which covers the window 22 when the rain flap 72 is allowed to hang down freely. The rain flap 72 may be secured about each window 22 by conventional securing systems. The rain flap 72 can be rolled out of the way of the window 22 and secured in the rolled up position with rain flap straps 74 or some other suitable fastening system.

The top panel 23 is attached to the ground cover 40, the side panels 21 and the end panel 29 by zippers 28 or some other suitable fasteners. Located along the foot end of the top panel 23 is a storage compartment 27 where the stakes 36, support poles 30 and miscellaneous other items can be stored when the sleeping bag system 10 is not erected. Affixed to the front corners of the top panel 23, as best seen in FIG. 1, are two tie down straps 34. The tie down straps 34 are secured to the ground with stakes 36 when the sleeping bag system 10 is erected. However, it can be appreciated by one skilled in the art that the stability of the erected sleeping bag system 10 may be obtained using other stabilization methods.

Figure 7:
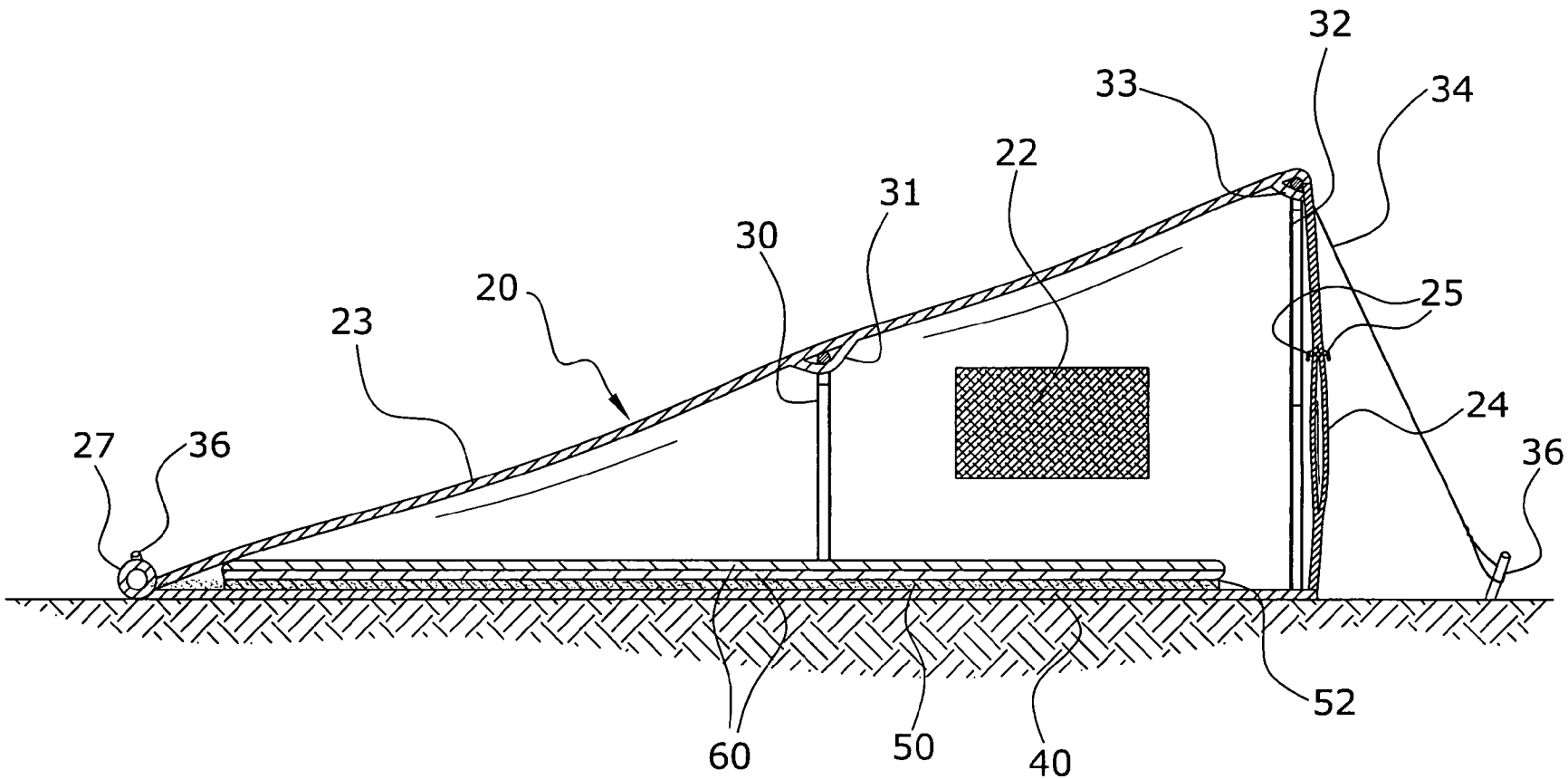
FIG. 7. is a sectional view of the system taken along line 7—7 of FIG. 2 showing internal support poles, pad and sleeping bag.

The end panel 29 is attached to the ground cover 40, the side panels 21 and the top panel 23 by zippers 28 or some other suitable fastener. Preferably located within the approximate center of the end panel 29, is a two-way storage pocket 24. As best seen in FIG. 7, the two-way storage pocket 24 has zippers 25 affixed to the top end of the storage pocket 24. One zipper 25 is affixed to the outer wall of the end panel 29 when the sleeping bag system 10 is erected and one zipper 25 is affixed to the inner wall of the end panel 29 when the sleeping bag system 10 is erected.

As best seen in FIG. 7, the erected sleeping bag system's 10 physical structure is maintained by two support poles 30 and 32. The support poles 30 and 32 are preferably made from aluminum or some other durable and lightweight material. The support poles 30 and 32 may be collapsible to allow their storage in the top panel's 23 storage compartment 27. The support poles 30 and 32 have a length side and a width side which are connected at the corners with corner couplers 38. The sleeping bag system's 10 mid-point support pole 30 may be maintained in position within the sleeping bag system 10 by sliding the mid-point support pole 30 through a sleeve 31 attached midway down the interior side of the top panel 23. The sleeping bag system's 10 head-end support pole 32 may be maintained in position with the sleeping bag system 10 by sliding the head-end support pole 32 through a sleeve 33 attached at the head-end of the interior side of the top panel 23. However, it can be appreciated by one skilled in the art that the support poles 30 and 32 may be temporarily affixed to the canopy structure 20 by other fastening methods.

By lengthening the width of the sleeping bag 60, ground cloth 40, the top panel 23 and the two support poles 30 and 32 the system can be modified to provide a sleeping bag system 10 for more than one person.

In use, the sleeping bag system 10 is rolled out on the camping location. The support poles 30 and 32, and stakes 36 are removed from the top panel storage compartment 27. Two stakes 36 are used to secure the foot end of the canopy structure 20 to the ground surface. The width section of the mid-point support pole 30 is inserted through the mid-point support pole sleeve 31. The width section is connected to the length section of the support pole 30 with corner couplers 38 and placed to support the bottom half of the canopy structure 20. The width section of the head-end support pole 32 is inserted through the head-end support pole sleeve 33. The width section is connected to the length section of the support pole 32 with corner couplers 38 and placed to support the head end of the canopy structure 20. The tie down straps 34 attached to the head-end of the top panel 23 are attached to the ground structure using stakes 36. The top zipper 28 on the side panels 21 are connected along the length of the top panel 23. The zipper 28 along the end panel 29 is connected to the two side panels 21 and the top panel 23. The sleeping bag system 10 is now in its erected state.

To enter the sleeping bag system 10, one of the side panels 21 can be zippered open as best seen in FIG. 3. Depending on the climate conditions, the side rain flaps 72 can be either rolled up and secured with the rain flap straps 74 or left down. Depending on the desires of the user, the side panels 21 and end panel 29 can be either closed, zippered partially open or zippered open all the way to the foot end of sleeping bag system 10.

Figure 8A:
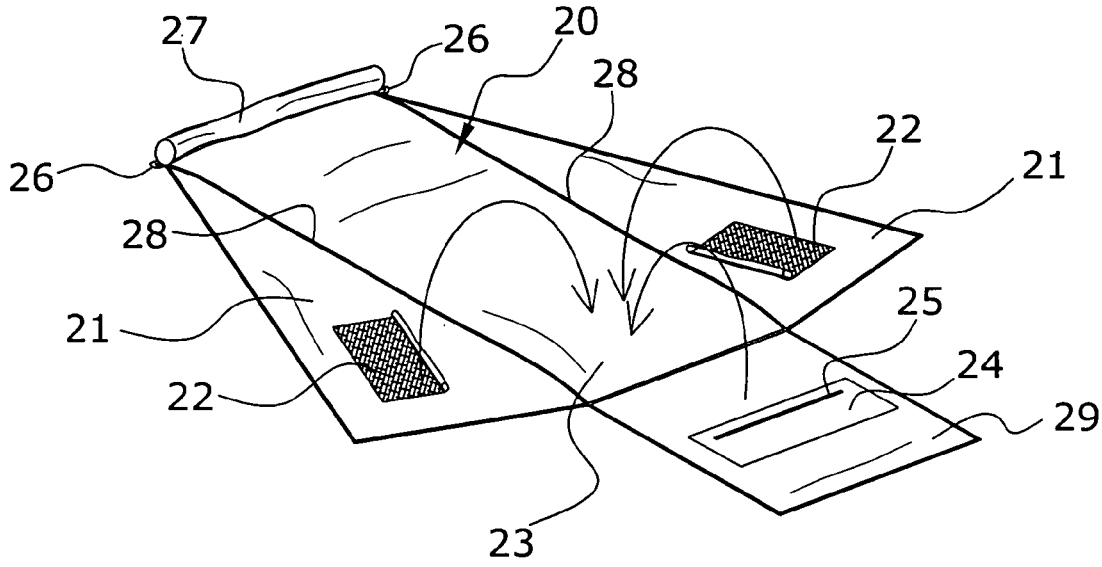
FIGS. 8*a*–8*c* illustrate the folding and storage of the present invention.
Figure 8B:
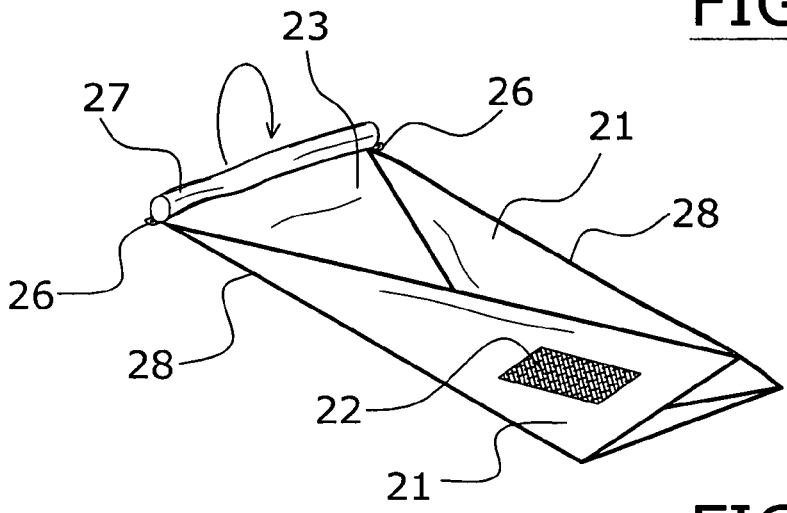
Figure 8C:
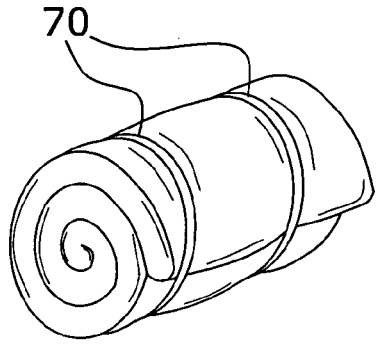

To take down and transport the sleeping bag system 10 the end panel 29 is unzippered from the two side panels 21 and the top panel 23 and laid flat on the ground structure. The side panels 21 are unzippered from the top panel 23 and laid flat on the ground. The tie down straps 34 are disconnected from the stakes 36. The head-end support pole 32 is taken apart and the width section is removed from the head-end support pole sleeve 33. The mid-point support pole 30 is taken apart and the width section is removed from the mid-point support pole sleeve 31. The two stakes 36 used to hold the foot end of the canopy structure 20 to the ground are removed. The support poles 30 and 32 and stakes 36 are placed in the top panel storage compartment 27. As best seen in FIGS. 8*a* through 8*c*, the two side panels 21 are folded over and on top of the ground cloth 40 and sleeping bag 60. The end panel 29 is then folded over and on top of the ground cloth 40 and sleeping bag 60. Beginning at the foot end of the sleeping bag system 10 the sleeping bag system 10 is rolled up towards the head end of the sleeping bag system 10. The storage ties 70 are used to secure the sleeping bag system in the stored and rolled up position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A sleeping bag system, comprising:

a sleeping bag;

a ground cloth attached to said sleeping bag;

a canopy attached to said ground cloth, wherein said canopy includes a pair of side panels, a top panel and an end panel which are interconnected to each other and said ground cloth with a plurality of zipper fasteners, wherein said end panel has a two-way storage compartment; and support poles attachable to said canopy for supporting said canopy about said sleeping bag.

2. The sleeping bag system of claim 1, wherein said ground cloth is made of water resistant material.

3. The sleeping bag system of claim 1, wherein said ground cloth is made of waterproof material.

4. The sleeping bag system of claim 1, wherein said sleeping bag is attached to said ground cloth with fasteners.

5. The sleeping bag system of claim 1, wherein said canopy has a top, an end and a pair of side panels.

6. The sleeping bag system of claim 1, wherein said canopy is made from water resistant materials.

7. The sleeping bag system of claim 1, wherein said canopy is made from waterproof materials.

8. The sleeping bag system of claim 1, wherein each of said pair of side panels has a window with a rain flap.

9. The sleeping bag system of claim 8, wherein said windows are manufactured with mesh.

10. The sleeping bag system of claim 8, wherein a fastening strap is attached to said side panel to secure said window rain flap in a rolled up position.

11. The sleeping bag system of claim 1, wherein said top panel has a storage compartment affixed thereto to store tent stakes and said poles.

12. The sleeping bag system of claim 1, wherein said support poles are collapsible, durable and lightweight.

13. The sleeping bag system of claim 1, wherein said sleeping bag is attached to said ground cloth in such a fashion as to provide a slot for insertion of an air-mattress or pad.

14. The sleeping bag system of claim 1, wherein fastening straps are attached to said ground cloth to secure the sleeping bag system into a rolled compact shape.

15. The sleeping bag system of claim 1, wherein said canopy is made from camouflage patterned material.

16. A sleeping bag system, comprising:

a sleeping bag;

a ground cloth attached to said sleeping bag;

a canopy attached to said ground cloth, wherein said canopy includes a pair of side panels, a top panel and an end panel;

a first support pole and a second support pole attached to said canopy for supporting said canopy about said sleeping bag, wherein said plurality of support poles are each comprised of an inverted U-shaped structure, wherein said first support pole is adjacent said end panel, wherein said second support pole is centrally positioned within said canopy, and wherein said first support pole is substantially taller than said second support pole;

at least one mid-point support pole sleeve attached to an inner surface of said canopy for receiving said second support pole;

a mesh side window positioned within one of said pair of side panels;

a two-way storage compartment positioned within said end panel;

a storage component attached to an end of said canopy opposite of said end panel; and a plurality of storage ties to secure said sleeping bag, said ground cloth and said canopy in a rolled-up position.

17. The sleeping bag system of claim 16, wherein said ground cloth is made of water resistant material.

18. The sleeping bag system of claim 16, a rain flap attached to one of said pair of side panels above said mesh side window.

19. The sleeping bag system of claim 16, wherein said top panel has a storage compartment affixed thereto to store tent stakes and said poles.

20. The sleeping bag system of claim 16, wherein said support poles are collapsible, durable and lightweight.

* * * * *